United States Patent [19]

Dolliner

[11] Patent Number: 4,862,717

[45] Date of Patent: Sep. 5, 1989

[54] PUNCH-BENDING MACHINE FOR WIRES OR STRIPS

[75] Inventor: Josef Dolliner, Baienfurt, Fed. Rep. of Germany

[73] Assignee: Kern+Dolliner Konstruktionen GmbH, Baienfurt, Fed. Rep. of Germany

[21] Appl. No.: 123,860

[22] PCT Filed: Feb. 21, 1987

[86] PCT No.: PCT/DE87/00058

§ 371 Date: Dec. 24, 1987

§ 102(e) Date: Dec. 24, 1987

[87] PCT Pub. No.: WO87/04954

PCT Pub. Date: Aug. 27, 1987

[30] Foreign Application Priority Data

Feb. 25, 1986 [DE] Fed. Rep. of Germany ..... 3606036

[51] Int. Cl.[4] ..... B21F 1/00

[52] U.S. Cl. ..... 72/7; 72/403; 72/447; 72/452

[58] Field of Search ..... 72/404, 403, 446, 447, 72/449, 452, 384, 7, 472, 429

[56] References Cited

U.S. PATENT DOCUMENTS

| | | | |
|---|---|---|---|
| 2,918,100 | 12/1959 | Knox et al. | 72/403 |
| 3,440,859 | 4/1969 | Holtzhauer | 72/404 |
| 3,600,923 | 8/1971 | Perrenoud | 72/452 |
| 4,030,172 | 6/1977 | Gentry | 72/404 |
| 4,203,477 | 5/1980 | Bruller et al. | 72/403 |

FOREIGN PATENT DOCUMENTS

| | | | |
|---|---|---|---|
| 202201 | 3/1956 | Australia | 72/404 |
| 460382 | 10/1949 | Canada | 72/452 |
| 1959907 | 5/1967 | Fed. Rep. of Germany . | |
| 1959881 | 6/1970 | Fed. Rep. of Germany | 72/403 |
| 2435996 | 2/1976 | Fed. Rep. of Germany . | |
| 2527088 | 1/1977 | Fed. Rep. of Germany . | |
| 3537085 | 4/1987 | Fed. Rep. of Germany . | |
| 1357292 | 2/1964 | France | 72/452 |
| 144542 | 8/1984 | Japan | 72/7 |
| 332948 | 11/1958 | Switzerland | 72/452 |

OTHER PUBLICATIONS

Gegenwart und Zukunft der pneumatischen Steuerungstechnik, Technische Rundschau, 43/85, pp. 44–49, 1985.

Antriebe der Biegeautomaten bestimmen Leistungsgrenzen, Drahtwelt, 4–1983, pp. 90–92, 1983.

*Primary Examiner*—Daniel C. Crane

*Attorney, Agent, or Firm*—Spencer & Frank

[57] ABSTRACT

A slide assembly particularly for a punching and bending machine which comprises a plurality of slide assemblies cooperating for the non-cutting shaping and forming of a workpiece. Each slide assembly is driven by its own servomotor which is mounted on a plate guiding a slide which supports a tool. The slide assemblies are fixed by way of mounting brackets to a planar base which preferably includes T-shaped grooves on both sides. All of the servomotors are synchronously regulated and/or program controlled.

13 Claims, 2 Drawing Sheets

21
18
17
16
16
24
15
30
27
29

18
21
22
20
19
15
23
26
24
25
30
27
28
29

PUNCH-BENDING MACHINE FOR WIRES OR STRIPS

BACKGROUND OF THE INVENTION

1. Field of the Invention

The invention relates to a punch-bending machine including a plurality of slide assemblies which interact for the non-cutting deformation of wires or strips, each unit being composed of a bedplate which can optionally be mounted in various positions and on which a slide carrying the tool is guided so as to be displaceable in the longitudinal direction, with a cam plate or crank which is rotatably mounted on the bedplate engaging at the slide. 2. Field of the Invention Automatic punch-bending machines are summarized, particularly with respect to their known drives, in the German periodical "Drahtwelt" [Wire World], 1983, No. 4, pages 90–92. These automatic punch-bending machines usually include a laterally preceding intake station for the precisely controlled intake of a continuous piece of material and, following it, one or a plurality of punching devices. Additional devices, such as, for example, welding devices or the like, may also be provided.

Among punch-bending mechanism equipped with mechanical drives, those equipped with a central gear are widespread. These machines usually have a vertically placed clamping table which has a round window in its center in which is mounted the disk-shaped central gear equipped with teeth at its frontal face. The slide assemblies are arranged around the central gear. To drive the slide, each slide assembly is equipped with a cam plate or crank fixed to a gear and these gears all mesh with the central gear. Although this ensures absolute synchronism at all speed settings, the obligatory circular arrangement of the slide assemblies and the limitation of slide movement in one plane resulted in difficulties in connection with the manufacture of complicatedly bent pieces. The operating range of the tool in the center of the central gear is relatively small.

DE-OS No. 2,527,088 discloses a drive for slide assemblies by means of a series of successive gears, each driving the next one. In this case, the bending center can be shifted from the center of the assembly plate. The position of the slide assemblies is not dependent upon the pitch of a central gear. However, the extraordinary stress on the gears at the beginning of the drive chain is a drawback. It results in great wear and a relatively early change in synchronism.

Also known are the so-called four-shaft machines (German Periodical "Drahtwelt" [Wire World], see above). Here, four shafts are arrnaged as a frame around a usually longer working field and drive the slide assemblies. Although in these machines, the movements of the tool can also be reliably coordinated, the resulting structures are heavy and employ rigid tool systems which often necessitate changes of direction in the slide assemblies.

While in the above-described machines the tool slides move essentially in one plane, DE-OS No. 2,435,996 discloses a punch-bending machine which has freely movable slide assemblies. In these machines, the cam plates of the slide assemblies are either driven from a central drive by means of flexible rotary shafts or a plurality of cam plates are combined on a common drive shaft and flexible push-pull cables trasnfer the lifting movements picked up from the cam plates directly to the tool slides. These machines exhibit good synchronism and are quickly and easily changed to new workpiece shapes. However, their weak point is probably the limitation of the deformation forces that can be generated. Also, this type of structure is presently available only for wires up to 8 mm.

The punch-bending machine disclosed in DE-GM 1,959,907, in which each slide assembly has its own hydraulic drive piston to move the tool slide, exhibits the same advantage of great flexibility. However, the control of these hydraulic drives requires an extremely complicated valve mechanism and it has not yet been possible to realize perfect synchronism and simply coordination of movements. Additionally, the relatively rigid hydraulic line connections are an impediment and, with the large number of line connections involved, the danger of leakages cannot be overlooked. Pneumatic working cylinders which can be operated by way of flexible lines are even more difficult to synchronize and do not produce sufficient deformation forces.

SUMMARY OF THE INVENTION

It is the object of the present invention to provide a punchbending machine which, in spite of a spatially freely movable arrangement of the slide assemblies, develops sufficient driving forces and high-grade synchronism and provides the possibility of accurate program control for the tool slides.

This is accomplished by the invention, based on a punch-bending machine of the above-mentioned type, in that the slide of each slide assembly is driven by a rotating motor. The motor is preferably mounted on the respective bedplate. So-called servomotors are employed which can be operated in synchronism by means of a common synchronism control device, thus realizing not only identical numbers of revolution but also angular positions for the individual cam plates which are identical at any point in time. The servomotors may also, possibly additionally, be controlled according to a certain program, for example if instead of cam plates, crank drives are used to move the slides.

Further advantages of individual electric motor drives are the problem-free arrangement of supply lines and the low consumption of driving energy. Even if the slide assemblies are arranged at an angle to the mounting plate and in all directions in space, the electrical supply cables do not interfere. The distance between the individual slide assemblies may be as large as desired, as required by the piece to be bent and as desired with respect to the simplest possible configuration of the bending tools. Because of the design of the control arrangements for the motors primarily according to modern electronics technology and the motors themselves, the investment costs for such punch-bending machines can be expected to be low. In any case, however, the amount of planning and the time required to reset the machine for a new workpiece can be reduced compared to prior art machines.

With regard to the structure of the individual slide assembly, it is of advantage for the shaft of the motor or of an associated drive and the cam plate or crank to be arranged with their axes perpendicular to the bedplate and to be in driving connection by means of spur gears or chains and chain wheels let into the bedplate. Unless cup-shaped cam plates are employed, it is proposed to provide a return spring inserted in the bedplate underneath the slide to push the slide against the outer contour of the cam plate.

This results in relatively flat bottom plates which have a planar contact face and preferably slits or elongated holes through which they are screwed on.

The desired spatially freely movable arrangement of the slide assemblies is preferably accomplished in that the motors of the slide assemblies are program controlled. The mounting brackets may be angle brackets, sloped blocks, bridge-type construction elements or the like which are provided with numerous screw holes or slots to connect them, on the one hand, with the plates of the slide assemblies and, on the other hand, with sliding blocks which are displaceable in T-shaped grooves of the base plate. The intention in any case is that these mounting brackets as well as can be used in many ways. Advantageously, the base plate is arranged so as to be slightly tilted back with respect to the vertical, which results in the best accessibility of the work zone of the bending tools.

The base plate, which is preferably provided with a central window, forms the essential supporting element of a punching and bending device which operates with slide assemblies as described above. In a known manner, feeding, punching and accessory devices can be attached to the side, front or back of the base plate. Or, instead of a planar base plate, a curved mounting plate or any type of threedimensional clamping framework may be provided for attachment of the slide assemblies.

In principle, the machine or device may be designed as a modular system. Only as many slide assemblies are required in each case as are necessitated by the bent piece to be produced. The basic structure of the device, namely essentially the base plate or other supporting structure which does not include a drive or movable parts, is relatively simple and cost effective. In the course of time, additional slide assemblies can then be procured in accordance with production planning. Due to its extraordinary adaptability, the device is also excellently suited for particularly large or bulky pieces to be bent.

BRIEF DESCRIPTION OF THE DRAWINGS

One embodiment of the invention will be described below with reference to the drawing figure. In detail, it is shown in FIG. 1, a side view of the central portion of an automatic bending device.

DESCRIPTION OF THE PREFERRED EMBODIMENT

Figure 1:
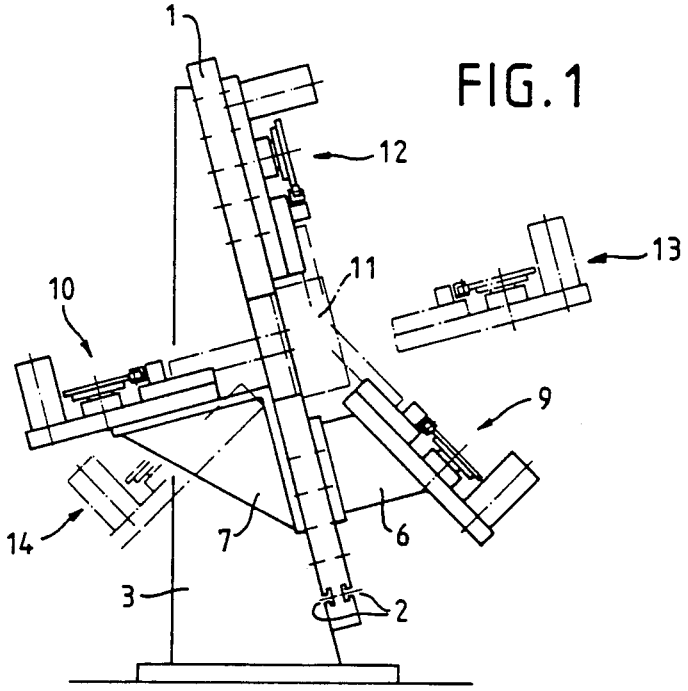
Figure 2:
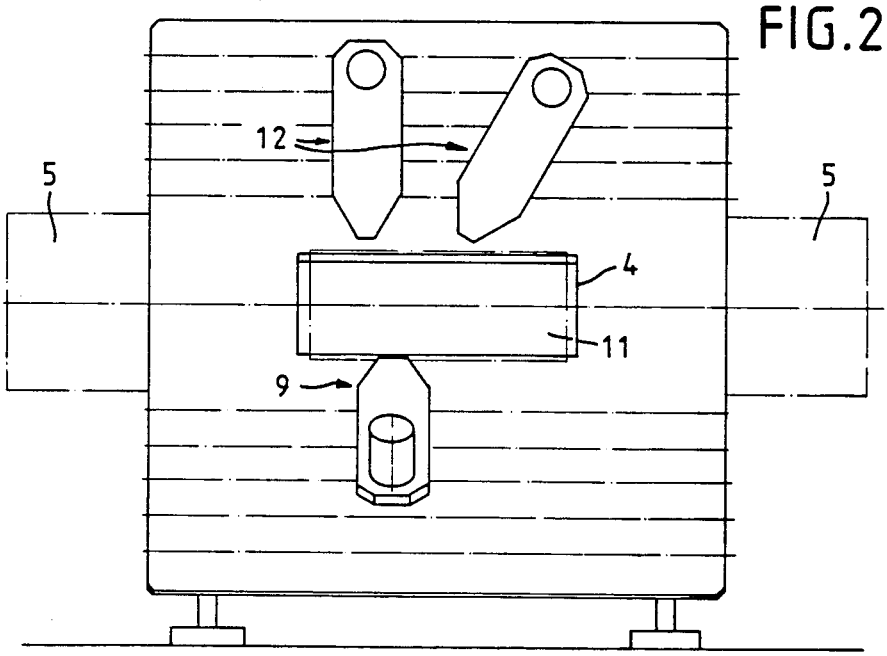
FIG. 2, a view from the right of the device according to FIG. 1.

FIGS. 1 and 2 show a base plate (1) having parallel surfaces and equipped on both sides with parallel T-shaped grooves (2) as they are customary in machine tool construction. Base plate (1) is inclined rearward at an angle of about 15° with respect to the vertical and is fixed by means of a pedestal (3). In its center, it has a rectangular window (4). The base plate may be enlarged to the right of left by further fastening surfaces (5) which are indicated by dash-dot lines. A feed station, punching devices, etc. may be fastened there.

Slide assemblies (9 and 10) are fastened to base plate (1) with the aid of mounting brackets (6 and 7). Mounting bracket (6) has the shape of a desk and mounting bracket (7) is angular. Both are screwed to base plate (1) and are also connected with the attached slide assemblies by means of screws. In the region of window (4), there is disposed the housing (11) of a multi-part bending tool with which the various slide assemblies cooperate. As will be described in connection with the remaining figuress, the individual slides are equipped with punching, bending or assembling tools and FIG. 1 shows that the same may move in any direction. Slide assembly (9) is arranged in such a manner that its stroke is directed upward from the front in an obliquely ascending manner toward the tool housing (11), while slide assembly (10) is disposed at the rear and its direction of movement is perpendicular to the base plate through window (4). Two further slide assemblies (12) are fastened directly to the front of base plate (1), likewise in different directions. Further slide assemblies (13 and 14), again in a different orientation, are indicated by dot-dash lines. They require corresponding mounting brackets (not shown).

Figure 3:
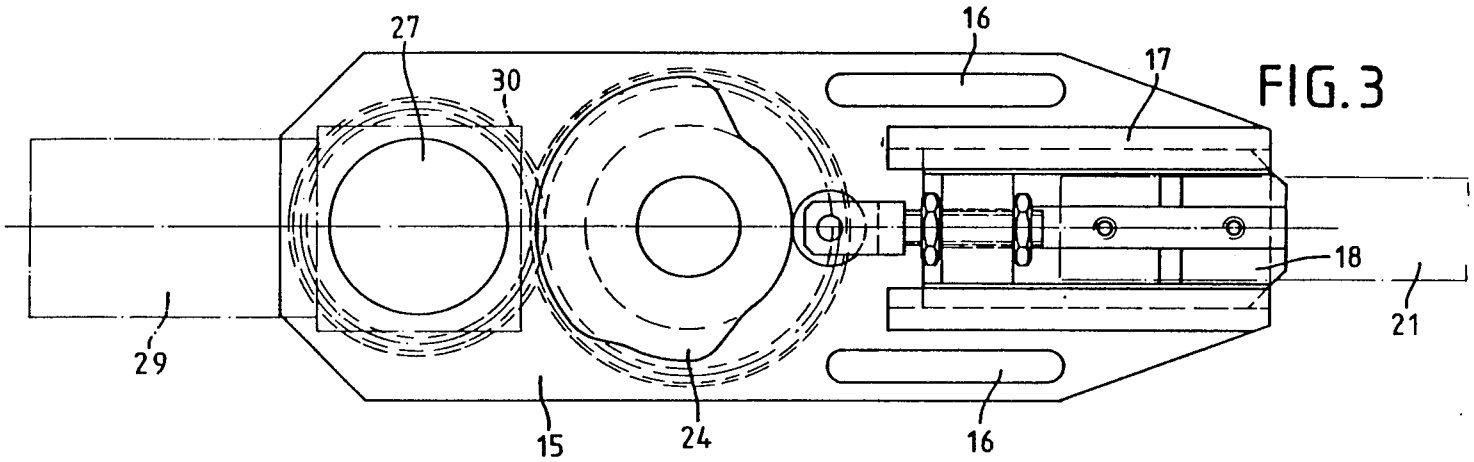
FIG. 3, a top view.
Figure 4:
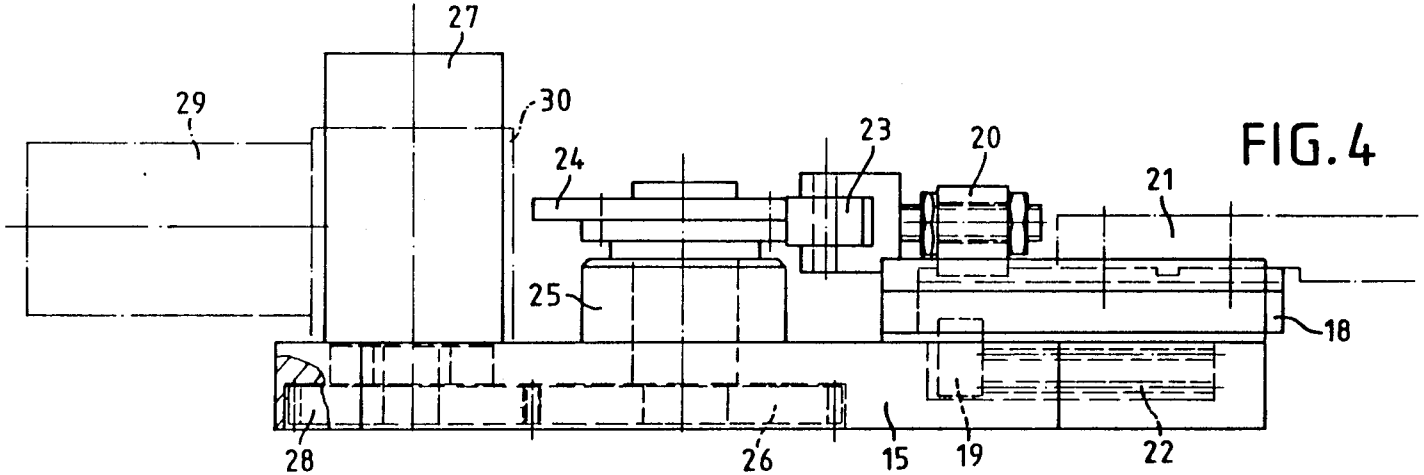
FIG. 4, a side view to a larger scale of the slide assemblies employed in the device according to FIG. 1.

As is known per se, the individual slide assembly shown in FIGS. 3 and 4 is constructed on a bottom plate (15) whose essentially rectangular base face tapers on one side and is provided with two fastening slots (16). A slide (18) is displaceably mounted in two parallel guides (17) and is provided with a downwardly projecting extension (19) and an upwardly projecting extension (20). On its surface, slide (18) is provided with crosswise grooves and tapped holes for fixing the associated bending finger (21) which is indicated by dash-dot lines. Beneath slide (18), a recess is located in bottom plate (15) to accommodate a return spring (22) and a projection (19). The spring is clamped in between the projection and the front wall of the recess. Projection (20) supports a sensing roller (23) which is adjustable with the aid of screws in the direction of movement of the slide and rests against a cam plate (24).

By means of a bearing (25), cam plate (24) is mounted in such a manner that its axis extends perpendicularly to bottom plate (15) and, at the lower end of the cam plate shaft, a drive gear (26) is seated which is inserted into a correspondingly dimensioned recess at the underside of bottom plate (15). A servomotor (27) is attached behind the cam plate in such a manner that its drive gear (28) is also accommodated by the recess at the underside of bottom plate (15) and meshed with drive gear (26). The recess may be closed by a lid which is flush with the underside of bottom plate (15). Instead of servomotor (27), a servomotor (29) may optionally be attached by way of an angular gear mechanism (30). Both are shown in dash-dot lines. In that case, the drive shaft of the angular gear mechanism would drive gear (28).

If a plurality of slide assemblies, individually driven by servomotors, are operated within a device, an electrical regulating device takes care that the cam plates of all slide assemblies are driven in synchronism.

I claim:

1. A punch-bending machine including a plurality of slide assemblies which cooperate for the non-cutting deformation of wires or strips, machine having means to receive said slide assemblies in different positions each said slide assembly comprising:

a plate mounted on said machine in any one of a plurality of different positions;

a slide supporting a tool, said slide being mounted on said plate for movement relative thereto along a predetermined path, said tool engaging said wires or strips;

an electric servomotor mounted on said plate; and force transmission means including a cam plate rotatably mounted on said plate, said force transmission means being connected between said servomotor and said slide for transmitting a force generated by said servomotor to said slide to cause said slide to move along said path relative to said plate.

2. A punch-bending machine as defined in claim 1, wherein said servomotor and said cam plate each include a shaft which extends perpendicular to the longitudinal axis of said plate, and each of said slide assemblies further comprises a spur gear connected to said shaft of said servomotor and disposed in said plate, and a spur gear connected to said shaft of said cam plate and disposed in said plate such that both of said spur gears drivingly connect said shaft of said servomotor to said shaft of said cam plate.

3. A punch-bending machine as defined in claim 1, wherein said servomotor includes an associated drive mechanism having a shaft and said cam plate includes a shaft such that said shaft of said associated drive mechanism and said shaft of said cam plate extend perpendicular to said plate, and each of said slide assemblies further comprises a spur gear connected to said shaft of said associated drive mechanism and disposed in said plate, and a spur gear connected to said shaft of said cam plate and disposed in said plate such that both of said spur gears drivingly connect said shaft of said associated drive mechanism to said shaft of said cam plate.

4. A punch-bending machine as defined in claim 1, wherein said plate includes a return spring disposed therein which applies a force to said slide in the direction of said force transmission means.

5. A punch-bending machine as defined in claim 1, further comprising means for synchronously regulating all of said servomotors.

6. A punch-bending machine as defined in claim 1, wherein said servomotors are program controlled.

7. A punch-bending machine as defined in claim 1, further comprising a base plate attached to said machine and mounting brackets for mounting at least some of said slide assemblies to said base plate, said base plate having at least one T-shaped groove therein.

8. A punch-bending machine including a plurality of slide assemblies which cooperate for the non-cutting deformation of wires or strips, said machine having means to receive said slide assembies in different positions, each said slide assembly comprising:

a plate mounted on said machine in any one of a plurality of different positions;

a slide supporting a tool, said slide being mounted on said plate for movement relative thereto along a predetermined path, said tool engaging said wires or strips;

an electric servomotor mounted on said plate; and force transmission means including a rotating crank mounted on said plate and engaging said slide, said force transmission means being connected between said servomotor and said slide for transmitting a force generated by said servomotor to said slide to cause said slide to move along said path relative to said plate.

9. A punch-bending machine as defined in claim 8, wherein said servmotor and said crank each include a shaft whose longitudinal axis extends perpendicular to said plate, and each of said slide assemblies further comprises a spur gear connected to said shaft of said servomotor and disposed in said plate, and a spur gear connected to said shaft of said crank and disposed in said plate such that both of said spur gears drivingly connect said shaft of said servomotor to said shaft of said crank.

10. A punch-bending machine as defined in claim 8, wherein said servomotor includes an associated drive mechanism having a shaft and said crank includes a shaft such that said shaft of said associated drive mechanism and said shaft of said crank extend perpendicular to said plate, and each of said slide assemblies further comprises a spur gear connected to said shaft of said associated drive mechanism and disposed in said plate, and a spur gear connected to said shaft of said crank and disposed in said plate such that both of said spur gears drivingly connect said shaft of said associated drive mechanism to said shaft of said crank.

11. A punch-bending machine as defined in claim 8, further comprising means for synchronously regulating all of said servomotors.

12. A punch-bending machine as defined in claim 8, wherein said servomotors are program controlled.

13. A punch-bending machine as defined in claim 8, further comprising a base plate attached to said machine and mounting brackets for mounting at least some of said slide assemblies to said base plate, said base plate having at least one T-shaped groove therein.

* * * * *